292-144 SM
8/14/84 OR 4,465,311

United States Patent [19]

Austin

[11] Patent Number: 4,465,311

[45] Date of Patent: Aug. 14, 1984

[54] REMOTE CONTROL LOCKING SYSTEM

[76] Inventor: George K. Austin, Rte. 2, Box 254B, Newberg, Oreg. 97132

[21] Appl. No.: 312,924

[22] Filed: Oct. 19, 1981

[51] Int. Cl.[3] ..... E05C 1/12; E05B 3/00; E05B 53/00

[52] U.S. Cl. ..... 292/144; 70/264; 70/279; 70/DIG. 48; 292/336.3

[58] Field of Search ..... 292/144, 201, 336.3; 70/264, 432, DIG. 48, 275, 279, 218; 91/1; 92/5 R

[56] References Cited

U.S. PATENT DOCUMENTS

| | | | |
|---|---|---|---|
| 913,700 | 3/1909 | Cornman | 292/150 |
| 1,154,439 | 9/1915 | Redman | 292/144 |
| 3,624,761 | 11/1971 | Kohn | 292/241 X |
| 3,648,568 | 3/1972 | Wright | 92/5 R |
| 3,691,902 | 9/1972 | Lebzelter | 92/5 R X |
| 3,926,460 | 12/1975 | Peterson | 292/144 |
| 3,966,289 | 6/1976 | Schlage | 292/144 X |
| 4,005,885 | 2/1977 | Austin | 292/144 |
| 4,021,066 | 5/1977 | McShane | 292/144 |
| 4,073,527 | 2/1978 | Schlage | 292/144 X |
| 4,169,616 | 10/1979 | Peterson | 292/144 |

FOREIGN PATENT DOCUMENTS

| | | | |
|---|---|---|---|
| 750705 | 6/1956 | United Kingdom | 292/144 |

OTHER PUBLICATIONS

*Schlage Electrified Locks,* Brochure printed by Schlage Lock Company, 1977, 4 pages.

*Primary Examiner*—Gary L. Smith
*Assistant Examiner*—Russell W. Illich
*Attorney, Agent, or Firm*—Klarquist, Sparkman, Campbell, Leigh & Whinston

[57] ABSTRACT

The present disclosure provides a fluid controlled door lock including a lock chassis, a lock bolt movable relative to the chassis, a door handle rotatable relative to the chassis along an axis, a clutch for interconnecting the lock bolt and the door handle, and a fluid control system operable in a direction substantially parallel to the axis and being connected to the chassis for operating the clutch. The fluid control system typically includes a cylinder having a fluid displaceable plunger therein which is adapted to selectively reciprocate in a direction parallel to the axis to operate the clutch.

10 Claims, 8 Drawing Figures

FROM PRESSURE CONTROL MEANS

REMOTE CONTROL LOCKING SYSTEM

BACKGROUND OF THE INVENTION

1. Field of the Invention

The invention relates generally to locking systems and more particularly to a remotely controlled system for locking a door.

2. Description of the Prior Art

Various systems for remotely controlling door locks have been described in the prior art. Both pneumatically and electrically controlled systems have been provided to permit doors to be remotely locked and unlocked. Pneumatically controlled systems typically include a pneumatically operated locking bolt which extends and retracts between the door to be locked and the frame in which the door is mounted. These systems normally utilize a pneumatically controlled plunger which is directly connected to the locking bolt so that displacement of the plunger results in a corresponding displacement of the locking bolt into or out of engagement with the door or the door frame. Such systems are disclosed in the following patents: U.S. Pat. Nos. 3,926,460; 1,154,439; 913,700; and British Patent No. 750,705. Another type of pneumatically controlled locking system is described in U.S. Pat. No. 3,624,761 which includes a pneumatically operable plunger engaging a locking pin received by the lock when the door is in a closed position. Another pneumatically controlled locking system is disclosed in my U.S. Pat. No. 4,005,885.

While the above patents all provide means for remotely controlling a door or window lock, these structures are not suitable for use as a part of a lock which is integral with a rotatable door handle.

A remotely actuated, electrically controlled locking system is disclosed in U.S. Pat. No. 4,073,527 to Schlage. This patent describes a door lock having a solenoid which, when used with conventional switches, displaces various components within an integral door handle lock to permit the lock to be controlled from a remote position. This system is therefore adapted for use in a commercial or industrial building where a single station controls the locked or unlocked mode of a plurality of locks, or in an apartment-type building where a plurality of stations control the mode of a single entry lock. The Schlage patent describes a door lock having a solenoid which selectively reciprocates along an axis which is perpendicular to the axis of rotation of the door handles. An alternate embodiment includes a simple thumb turn with a solenoid adapted to selectively reciprocate along the axis of rotation of the thumb turn.

More pertinent to the present invention are the commercial designs of the Schlage Lock Company, the assignee of the Schlage patent. One such locking system, designated model No. D80PDEL, is an electrically controlled lock which includes an electrical solenoid which is selectively reciprocated along the axis of rotation of the door handles. Reciprocation of the solenoid results in displacement of locking portions of the door lock to permit the lock to be remotely controlled. This model is electrically locked by continuous current until unlocked by operation of a switch, power failure, or through the use of a key. Schlage model No. D80PDEU is similar to the aforedescribed model except that it is mechanically held in a locked mode until mechanically unlocked by a key or electrically unlocked by electric current. Primarily because of the heat which builds up during operation, this system is specifically designed only for intermittent operation.

The Schlage locks thus provide a means for modifying conventional door handle locks for remote control. However, there are a number of drawbacks inherent with this type of electrical control system. With respect to model No. D80PDEL, which is electrically locked, power failure will necessarily result in all of the electrically controlled doors being unlocked. Thus, to obtain unauthorized entrance, one need only shut down the electrical system. Inadvertent opening of a particular lock may also occur in the event of a slight short in the lock circuitry. Moreover, since electricity is drawn by the locking system at all times the system is in locked mode, the operating cost could be substantial. It might also provide a fire hazard which could be particularly acute when the system is mounted within a wooden door, which is very often the case. With model No. D80PDEU, which is electrically unlocked, the locks may only be operated a certain number of times within a given time period because nothing is provided for dissipating the heat generated within the solenoid during repeated actuation. Also, in the event of a loss of power, no means is provided for unlocking the system without the use of a key; that is, there is no override capability other than the use of a key which could prove inconvenient and perhaps even dangerous during an emergency.

The described electrical locking systems also exhibit an inferior alarm sensing capability. Thus, for example, in the event of loss of power to a particular lock, no one would necessarily know without actually testing the lock that it was not operating in a perfectly normal manner. The use of an electrical solenoid renders it extremely difficult and therefore expensive to position insulated microswitches which sense the position of the solenoid and which could be mounted into the door to serve as an alarm. In the event such sensing capability would be built externally of the lock but within the door, installation of the lock would be far more difficult than with conventional locks.

Hence it is a primary object of the present invention to provide an improved remotely controlled locking system which effectively and reliably overcomes the aforementioned limitations and drawbacks of the prior art proposals. More specifically, the present invention has as its objects one or more of the following taken individually or in combination:

(1) The development of a remotely controllable locking system which in external appearance is no different from a conventional, nonremotely controlled door lock;

(2) The provision of a remotely controllable locking system which is fail-safe in that in the event of total loss of the control medium, the lock will remain in a locked position, thereby reducing the possibility of unauthorized entry;

(3) To develop a remote controlled locking system which can have a sensing capability built into it to sense when there is a loss of control function;

(4) The development of a remote controlled locking system which is operable at a minimal of expense and does not increase fire hazards; and (5) To provide a remote control locking system which is simple in construction, yet which provides means for positively locking and unlocking a large number of doors from one or more remote locations.

SUMMARY OF THE INVENTION

This invention responds to the problems presented in the prior art by providing a fluid controlled door lock comprising a lock chassis, a lock bolt movable relative to the chassis, a door handle rotatable relative to the chassis along an axis, means including a clutch for interconnecting the lock bolt and the door handle, and fluid control means operable in a direction substantially parallel to the axis and being connected to the chassis for operating the clutch. The fluid control means typically includes a cylinder having a fluid displaceable plunger therein which is adapted to selectively reciprocate in a direction parallel to the axis to operate the clutch.

Thus, the invention provides a remotely operable locking system which provides a safe, positive locking means, yet which is simple in design and therefore inexpensive to purchase and operate.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Structure of the Embodiment of FIGS. 1-7

The principles of this invention are particularly useful when embodied in a door lock such as that depicted in FIGS. 1-7 and generally indicated with the numeral 10. This type of door lock is the same as the aforementioned Schlage model Nos. D80PDEL and D80PDEU except that the electromagnetic components of these prior art models have been replaced with pneumatically operable control means.

Figures 1, 2, 3, 8:
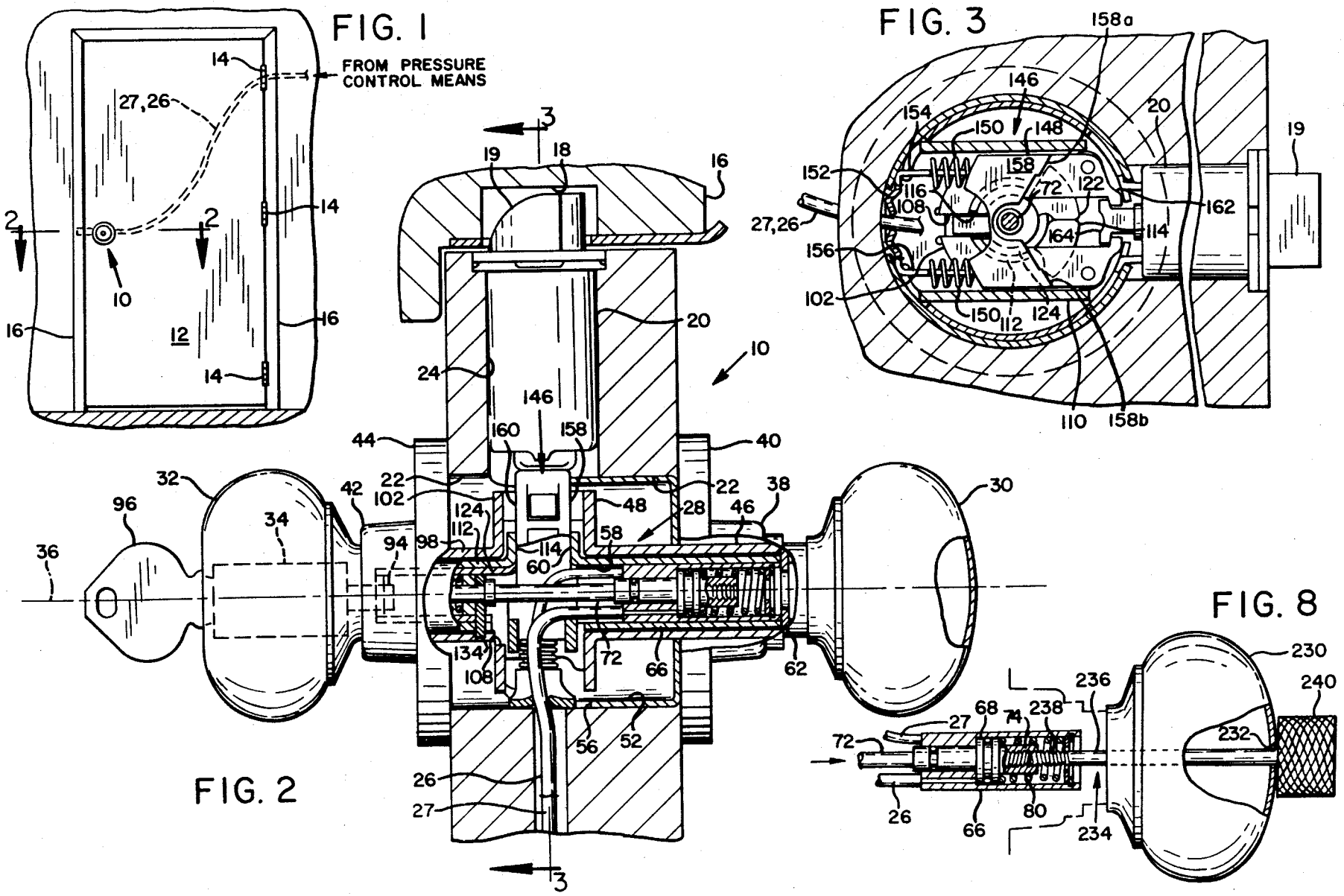
FIG. 1 is a side elevation view of a pneumatically controlled door lock mounted on a door shown in a closed and locked condition.
FIG. 2 is a sectional view taken along line 2—2 of FIG. 1.
FIG. 3 is a sectional view taken along line 3—3 of FIG. 2.
FIG. 8 is a partially cutaway view of a modified door knob assembly and manual override device which may be used in place of the corresponding door knob depicted in the other figures.

As depicted in FIG. 1, the door lock 10 is typically installed in a door 12 to swing along a vertical axis by means of one or more hinges 14 of conventional design. A door frame 16 surrounds the door 12 and includes a strike box 18 which receives a latch bolt 19 which extends outwardly from the door lock 10 and the door 12 through a latch bolt casing 20 disposed within an edge bore 24. A cross bore 22 in the door 12 extends at right angles to the edge bore 24 and receives the major portion of the door lock 10.

A pneumatic control conduit 26 and a pneumatic sensing conduit 27 are depicted in phantom in FIG. 1 and pass through the door 12 to one of the hinges 14. Pneumatic conduits 26 and 27 are normally flexible so that they can pass across the hinge 14 and into the door frame 16 without any complicated arrangement. Of course, a sufficient amount of slack must be provided in the pneumatic conduits 26 and 27 in order to prevent the tensioning thereof as the door 12 is opened.

FIG. 2 best depicts a lock chassis 28 which is mounted within the cross bore 22. The lock chassis 28 is provided with a pair of knobs, one of which will be designated the interior knob 30, the other being the exterior knob 32. The exterior knob 32 is provided with a key receiving structure 34 in order to permit authorized entry even when the door lock 10 is in a locked mode. While a pair of axially aligned door knobs 30 and 32 are depicted and described, any number of other conventional manual control means may alternatively be provided. For example, it may be desirable to delete the exterior knob 32 and merely provide a plate (not shown) adapted to receive a key. Moreover, the exterior plate or knob 32 need not be in axial alignment with the interior knob 30. Nonaligned control means (not shown) could be provided along with downwardly or upwardly extending connection means, such as that described in U.S. Pat. No. 4,073,527.

The depicted interior and exterior knobs 30 and 32 are rotatable about an axis 36 extending along the centerline of the cross bore 22. The interior knob 30 is supported on an interior rose 38 and an interior casing 40, while the exterior knob 32 is supported on an exterior rose 42 and an exterior casing 44.

The Interior Side of the Lock Chassis

The side of the lock chassis 28 adjacent the interior knob 30 will first be described. As shown best in FIGS. 2 and 4, a first bushing 46 extends from the central portion of the door lock 10 outwardly into the interior rose 38, and is fixed with respect to the interior rose and door 12. The term "central" as used throughout the remainder of this description will thus define the direction toward the center of the lock chassis 28, while the term "remote" will be used to define the opposite direction. This first bushing 46 includes an annular shoulder 48 adjacent its central end which is adapted to engage an axial face 50 of a first shield member 52 through which the first bushing passes. The first shield member 52 includes a pair of opposed cutout portions 54 and 56, the purpose of which will become evident as this discussion continues.

The first bushing 46 is adapted to rotatably receive a substantially cylindrical first spindle 58 which extends from and is affixed to the interior knob 30, and which includes a roll-back portion 60 adjacent its central end, defining a pair of camming edges **60*a* and 60*b*. This roll-back portion 60 is disposed adjacent the annular shoulder 48 of the bushing 46 when the door lock 10 is fully assembled (See FIG. 2). A floor member 62 having a central opening therein is affixed within the first spindle 58** adjacent the midportion thereof.

A pneumatic control cylinder 66 is disposed within the first spindle 58 with its remote end in abutment with the floor member 62. The pneumatic control cylinder 66 includes a plunger 68 with a plunger O-ring 70, the plunger being affixed to a plunger rod 72 which has a plunger rod O-ring 73. The remote end of the plunger rod 72 includes a threaded bore 74, while a plunger rod shoulder 76 is disposed in the vicinity of the opposite end. A pneumatic control chamber 78 is defined within the pneumatic control cylinder 66, the control chamber being adapted to receive the plunger 68, a control cylinder spring 80, a spring seat 82, and a retainer 84. A control cylinder shoulder 86 defines the central end of the control chamber 78 and is adapted to limit the travel of the plunger 68 in a central direction.

A pneumatic control passage 90 is provided through the pneumatic control cylinder 66, with a serrated nipple 88 being mounted adjacent the centrally disposed end to engage the pneumatic control conduit 26, thereby interconnecting the pneumatic control conduit with the control chamber 78. Positioned thusly, the pneumatic control conduit 26 is directed through the second cutout portion 54 in the first shield member 52, out of the cross bore 22, and into the door 12.

Figures 4, 5, 6, 7:
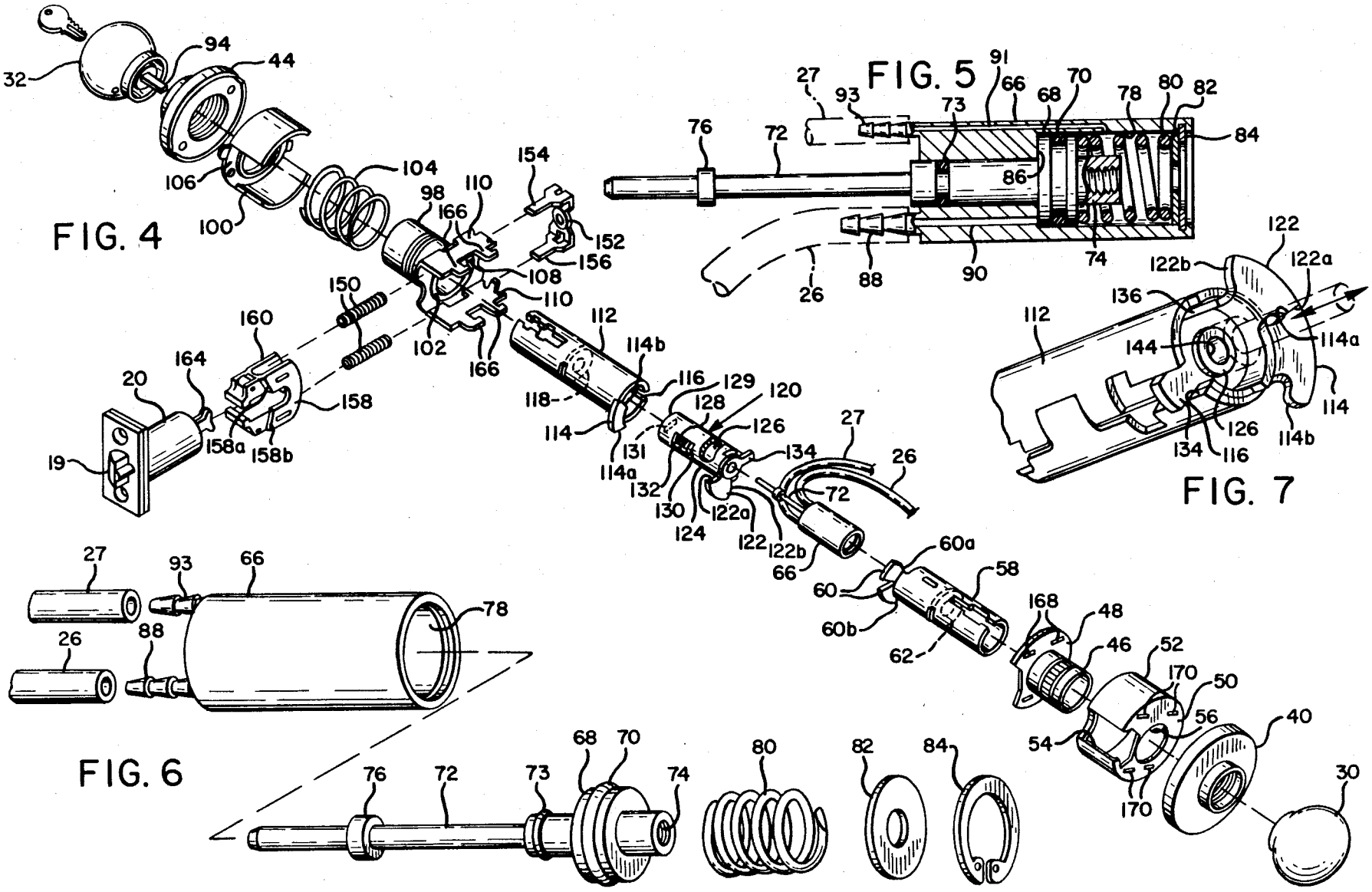
FIG. 4 is an exploded view of the embodiment of FIGS. 1—3.
FIG. 5 is a partially sectioned view of the pneumatic plunger assembly taken along 5—5 of FIG. 4.
FIG. 6 is an exploded view of the pneumatic control cylinder depicted in FIGS. 2, 4 and 5.
FIG. 7 is a perspective view of a portion of the locking assembly actuated by the pneumatic control cylinder.

A pneumatic sensing passage 91 is provided through the pneumatic control cylinder 66, with a serrated nipple 93 being mounted adjacent its centrally disposed end to engage the pneumatic sensing conduit 27. As depicted in FIG. 5, the pneumatic sensing passage 91 is desirably disposed in the pneumatic control cylinder 66 on the opposite side or 180° apart from the pneumatic control passage 90. The remotely disposed end of pneumatic sensing passage 91 enters the control chamber 78 at a position spaced from the control cylinder shoulder 86 to interconnect the pneumatic sensing conduit 27 with the control chamber. Like the pneumatic control conduit 26, the pneumatic sensing conduit 27 passes through the second cutout portion 54 in the first shield member 52, out of the cross bore 22, and into the door 12.

The Exterior Side of the Lock Chassis

The other side of the lock chassis 28, that is, the exterior side, will now be described. As indicated above, the exterior knob 32 normally includes a key receiving structure 34. The key receiving structure 34 is of conventional design, of the type included in Schlage's model Nos. D80PDEL and D80PDEU, so will not be described and has not been depicted in detail. The key receiving structure 34 includes a centrally extending, flat tang 94 which is rotatable only when a key 96 is inserted therein.

A second bushing 98 extends into the exterior rose 42 through a second shield member 100 and is fixed with respect to the exterior rose and the door 12. The second shield member is of somewhat lesser diameter than the first shield member 52. The second bushing 98 includes an annular shoulder 102 which acts as a seat for a shield spring 104 disposed between the annular shoulder and an axial face 106 of the second shield member 100. The shield spring 104 is provided to facilitate the tightening of the exterior casing 44 against the door 12. The second bushing 98 and its annular shoulder 102 include a longitudinal slot 108 extending from the centrally disposed end of the second bushing for a portion of its length. The second bushing 98 also includes a body structure 110 mounted adjacent its central end. This body structure 110 assists in the assembly of the lock chassis 28 as will be explained below.

The second bushing 98 rotatably receives a second spindle 112 which is affixed to and extends from the exterior knob 32. The second spindle 112 is similar in structure to the first spindle 58 except that the second spindle includes a roll-back portion 114 adjacent its centrally disposed end which is substantially narrower than the roll-back portion 60 of the first spindle. Like roll-back portion 60, roll-back portion 114 includes camming edges **114*a* and 114*b*. A longitudinal groove 116 is provided in the centrally disposed end of the second spindle 112 and is adapted to be aligned with the longitudinal slot 108 of the second bushing 98**.

The second spindle 112 includes a floor member 118 having an opening therein, the floor member acting to support the remote end of an actuating body 120 rotatably disposed within the second spindle 112. The actuating body is comprised of a tubular member 124 with an actuating piston 126 reciprocally disposed therein. A roll-back portion 122 including camming edges **122*a* and 122*b* extends from the tubular member 124 and is of such configuration that when the lock chassis 28 is fully assembled, the camming edges 122*a* will abut the camming edge 114*a* of the second spindle roll-back portion 114 (see FIGS. 3 and 7). As shown in FIG. 4, an actuating body spring 128 exerts an outward or centrally directed force on the actuating piston 126. The remote end of the actuating body spring 128 is disposed against an actuating body floor member 129, which includes a tang engagement slot 131 adapted to receive the tang 94 of the key receiving structure 34. The actuating body spring 128 is substantially weaker than the control cylinder spring 80 for reasons which will become evident when the operation of the door lock 10 is described. A spring stop 130 is rotatably mounted to the remote end of the actuating piston 126 and extends outwardly from a slot 132 in the tubular member 124. Thus, the actuating piston 126 is free to rotate within the tubular member 124 as turned by the key receiving structure 34 and tang 94. Without any force exerted downwardly or in a remote direction upon the actuating piston 126, the actuating piston will be disposed as depicted in FIG. 4 with the spring stop 130 in abutment against the tubular member 124 at the end of the slot 132**.

A locking finger 134 is affixed to the centrally disposed end of the actuating piston 126 and extends radially outwardly sufficiently far that it will extend through both the longitudinal groove 116 in the second spindle 112 and the longitudinal slot 108 in the second bushing 98. With the actuating piston 126 in its depressed or remotely disposed condition depicted in FIGS. 2 and 7, the locking finger 134 will prevent relative rotation between the second spindle 112 and the second bushing 98 (see FIG. 3). This fixes the position of the exterior knob 32 with respect to the door 12 because the second spindle 112 is mounted to the exterior knob, while the second bushing is fixed with respect to the door. Rotation of the actuating piston 126 is still possible within the second spindle 112, however, to the extent permitted by a circumferential shoulder 136 in the tubular member.

With the actuating piston 126 in its raised or centrally disposed position (not shown), rotation of the second spindle 112 within the second bushing 98 is possible because the centrally disposed edge of the second spindle 112 is disposed below or remotely of the now-raised or centrally disposed locking finger 134. Rotation of the actuating piston 126 within the second spindle 112 is, of course, still permitted with the actuating piston in this raised position.

The actuating piston 126 includes a bore 144 adjacent its central end, which is designed to receive the plunger rod 72. The plunger rod shoulder 76 thus abuts the centrally disposed end of the actuating piston 126. With the lock chassis 28 in its assembled position depicted in FIG. 2, the control cylinder spring 80 will oppose the actuating body spring 128. Since the control spring 80 is substantially heavier than the actuating body spring 128, the actuating body spring and the actuating piston 126 will be depressed or remotely disposed, taking the position depicted in FIGS. 2 and 7.

The Slide Means

FIG. 2 also shows that a substantial axial spacing is provided between the first spindle roll-back portion 60 on the exterior side, and the second spindle and actuating body roll-back portions 114 and 122 on the interior side. Slide means 146 is provided within this space in order to translate the rotational displacement of the the roll-back portions 60, 114, and 122 into reciprocation of the latch bolt 13. The slide means 146 includes a slide member 148 which is maintained adjacent the plunger rod 72 by a pair of slide springs 150 which extend between the slide member and a slide spring mount 152 having a pair of spring engagement legs 154 and 156. The slide spring mount 152 is affixed to the body structure 110, within which the slide member is reciprocable.

The slide member 148 includes an interior facing side 158 and an exterior facing side 160. These two sides 158 and 160 are identical in that they each include a pair of cam following edges **158*a* and 158*b* and 160*a* and 160*b* which extend in radial lines as if from the center of the plunger rod 72. The cam following edges 158*a* and 158*b* of the interior facing side 158 are disposed in abutment with the camming edges 60*a* and 60*b* of the first spindle roll-back portion 60. The cam following edges 160*a* and 160*b* of the exterior facing side 160 are in abutment with one of the second spindle camming edges 114*b* and one of the actuating body camming edges 122*b*. Because of this disposition, rotational displacement of any of the camming edges will result in displacement of the slide member against the slide springs 150. The slide member 148 also includes a pair of draft links 162 which engage a T-member 164 at the central end of the latch bolt 13, so that movement of the slide member 148 toward or away from the edge of the door 12 results in a corresponding displacement of the latch bolt. Thus, the spindle roll-back portions 60, 114, and 122, the pneumatic control cylinder 66, the actuating piston 126, and the slide means 146 all cooperate to perform a clutching operation between the knobs 30 and 32 and the latch bolt 13**.

With the lock chassis 28 fully assembled, the second shield member 100 nests within the first shield member 52 with the two shield members enclosing the lock chassis to prevent tampering. So assembled, four nibs 166 which extend from the body structure 110 are engaged within two sets of corresponding apertures 168 and 170 in the first bushing annular shoulder 48 and the first shield member axial face 50, respectively. The latch bolt 13 thus extends through the first shield member first cutout portion 54, while the pneumatic conduit 26 extends through the second cutout portion 56.

Operation of FIGS. 1–7

The preferred embodiment is designed to operate in a fail-safe condition with the door lock 10 being unlocked through the use of pneumatic pressure; that is, with ambient pressure in the pneumatic conduit 26, the door lock will be in a locked mode. Thus, by cutting the pneumatic conduit 26 or by reducing the pneumatic pressure in any other way, as might be attempted by one trying to obtain unauthorized access to the locked spaces, the door lock will not be unlocked.

The Locked Mode

The door lock 10 is depicted in a locked mode in FIG. 2. This assumes that the pneumatic pressure in control chamber 78 will be at or near ambient. In any event, the pressure will not be sufficiently great to cause displacement of the plunger 68 away from the control cylinder shoulder 86. As discussed above, since the control cylinder spring 80 is heavier than the actuating body spring 128, the actuating piston 126 will be in the depressed or remotely disposed position depicted in FIGS. 2 and 7. With the actuating piston 126 and its locking finger 134 in the depicted position, rotation between the second bushing 98 and the second spindle 112 will not be permitted (see FIG. 3). This is because the locking finger 134 extends through the longitudinal groove 116 in the second spindle 112 and the longitudinal slot 108 in the second bushing 98. Because this rotation is not permitted and since the second bushing 98 is fixed with respect to the lock chassis 28 and the door 12, the second spindle 112 will be fixed with respect to the door and the roll-back portion 114 of the second spindle and its camming edge **114*b* will not be able to displace the slide member 148. Thus, the latch bolt 19 will be maintained in its depicted, extended position within the strike box 118**.

With the door lock 10 in this locked mode, it is desirable that someone be able to obtain entry through the use of a key 96. This is made possible in the depicted embodiment through the insertion of an appropriate key 96 into the key receiving structure 34. Rotation thereof causes the tang 94 to rotate the actuating body 120 via the tang engagement slot 131. This rotation of the tubular member 124 and its roll-back portion 122 causes the camming edge **122*b* to displace the cam following edge 160*a* of the slide member 148 against the pressure of the slide springs 150, thus retracting the latch bolt 19 into the door 12 to permit the door to be opened. When the key 96 is removed or the rotational force is released, the slide springs 150 cause the exterior knob 32, the latch bolt 19, and all interconnecting components to return to their original position. These components can thus be seen to cooperate to act as a clutch between the exterior knob 32 and the latch bolt 19**.

In this locked mode, the door 12 may still be opened from the interior side. This is because the first spindle 58 and its roll-back portion 60 is free to rotate with respect to the first bushing 46. Thus, rotation of the interior knob 30 in either direction causes the first spindle roll-back portion camming edges **60*a* or 60*b* to be rotated against the interior facing cam following edges 158*a* or 158*b* to displace the slide member 148 against the slide springs 150, thereby retracting the latch bolt 19 into the door 12**.

The Unlocked Mode

In the event the door lock 10 is to be shifted to an unlocked mode, such as might be desirable during the day in an industrial or commercial building, the pneumatic pressure within the control chamber 78 is increased via the pneumatic conduit 26 until the plunger 68 in the pneumatic control cylinder 66 is displaced in a remote direction toward the interior knob 30, or to the right as shown in FIG. 2. This causes the plunger 68 to uncover the pneumatic control passage 91, thereby conveying system pneumatic pressure into the pneumatic sensing conduit 27. Appropriate pneumatically sensitive switching means (not shown) is provided, along with an indicator, to indicate at a remote operating station that the door lock 10 has shifted to an unlocked mode. Thus, in the event of a break in the pneumatic control conduit 26, which might prevent the plunger 68 from shifting to its unlocked position, the operator would have a means for knowing that a problem exists.

The remote movement of the plunger rod 72 permits the actuating body spring 128 to displace the actuating piston 126 to its raised or centrally disposed position. In this position the locking finger 134 still is engaged within the longitudinal slot 108 of the second bushing 98 but is disposed above (to the right in FIG. 2) of the centrally disposed end of the second spindle 112; that is, the second spindle and the second bushing are not rotationally locked with respect to one another. This permits the exterior knob 32 which is affixed to the second spindle 112 to be rotated, thus causing one of the second spindle roll-back portion camming edge 114*b* to force the slide member 148 against the slide springs 150, thereby causing the latch bolt 19 to retract into the door 12. Thus, the door 12 may be opened from the exterior without the use of a key.

Advantages of the Embodiment of FIGS. 1–7

The door lock 10 thus provides a means for remotely controlling the mode of one or more door locks. It is particularly suited for use in a large building having many door locks which may be controlled from a single remote position. So designed, a single air compressor, desirably having some storage capacity, may be utilized to provide pneumatic pressure to all of the door locks in a particular building. Since very little air is used in both the locked and unlocked modes, a relatively small compressor and storage system may be utilized. Yet, despite the small amount of air used and the small size of the pneumatic tubing, positive shifting between locked and unlocked modes is provided by the present invention. In the event of an electrical power failure, the storage capacity in the compressed air system would provide sufficient air to control all of the locks in the building for a substantial period of time. Also, with the system operating in a fail-safe mode in which the locks are pneumatically unlocked, a cutoff in the air supply would not result in the opening of the locks.

The sensing means built into the door lock 10 sends a signal to an operating station to notify the operator in the event the position of the plunger 68 does not correspond to the desired locked or unlocked mode. This type of pneumatic sensing means has previously been used in pneumatically operated deadbolt locks but has not been provided in a door lock of the type described and depicted herein.

The design of the door lock 10 alternatively permits one or more microswitches (not shown) to be mounted within the lock, typically adjacent the pneumatic control cylinder 66, to sense the position of the plunger 68. The microswitches would then be able to send an alarm signal to an appropriate station, thus providing the sensing capability pneumatically provided in the depicted, preferred embodiment. This electrically actuated sensing capability is a feature which would be difficult and expensive to incorporate in an electrically controlled lock or any other lock of the prior art.

Structure and Operation of the Embodiment of FIG. 8

The alternate embodiment of FIG. 8 includes a door knob 230 which is adapted to replace interior knob 30 of the aforedescribed door lock 10. Door knob 230 is identical to interior knob 30 except that it includes a small hole 232 which is adapted to receive a manual override device 234. The manual override device 234 includes a narrow, extending shank 236 which is threaded at its free end 238. The opposite end of the shank 236 includes a substantially cylindrical, knurled handle 240.

The manual override device 234 is adapted to be inserted through the hole 232 in the door knob 230 and to be extended through the control cylinder spring retainer 84 and the spring seat 82 and threaded into the plunger bore 74. As the manual override device 234 is threaded into the plunger bore 74, the handle 240 comes into abutment with the surface of the door knob 230, thereby compressing the control cylinder spring 80 and drawing the plunger 68 toward the door knob in a remote direction. FIG. 8 depicts the manual override device 234 just as its threaded end 238 begins to engage the plunger bore 74. As the handle 240 is rotated, the plunger 68 is drawn toward the door knob 230, or in a remote direction, compressing the control cylinder spring 80. This movement of the plunger 68 and the plunger rod 72 permits the actuating body spring 128 to push the actuating piston 126 to an extended, centrally disposed position so that the locking finger 134 clears the centrally disposed end of the second spindle 112, thereby permitting relative rotational movement between the second spindle and the second bushing 98. When the exterior knob 32 and the second spindle 112 affixed to it are rotated, the second spindle roll-back portion camming edge 114*b* acts upon the exterior facing cam following edge 160*b* of the slide member 148, compressing the slide springs 150 and causing the latch bolt 19 to retract into the door 12. Thus, when the manual override device 234 is used with the door knob 230, the operation of the door lock 10 from the exterior side is just as if air pressure had been used to shift the pneumatic control cylinder plunger 68 to its unlocked mode. This operation may be desirable in the event of a pneumatic system failure, which might otherwise prevent the unlocking of the door lock without the use of an appropriate key.

Because the hole 232 in the door knob 230 permits the possibility of unauthorized tampering with the door lock 10, door knob 230 is not normally used on a permanent basis. Rather, a number of door knobs 230 and manual override devices 234 may be kept on hand for emergency use in the event of pneumatic system failure.

The possibility of use of the manual override device 234 thus provides yet another advantage of the door lock 10 over conventional designs, such as the electrically controlled Schlage locks described above. It would be extremely difficult to design an arrangement where a similar, simple tool could be threaded into an electrical solenoid to permit the manual operation thereof.

While this description has been directed to a pneumatically controlled system, it should be appreciated that any other fluid control media may alternatively be used. Various other changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A fluid-controlled door lock for use in a door comprising:

a pair of rotatably mounted door handles, at least one of which is rotatable along an axis which extends substantially perpendicularly through the door;

latching means extending in a direction substantially perpendicular to said axis for latching the door into a fixed position, the position of said latching means being controllable by said handles;

locking means selectively displaceable between first and second positions which are axially displaced with respect to one another along said axis to prevent rotation of at least one of said handles when said locking means is in said first position, rotation being permitted when said locking means is in said second position;

fluid operated means for selectively displacing said locking means between said first and second positions, thereby locking and unlocking said handles;

a mechanical override device; and said fluid-operated means including means for engaging the mechanical override device to permit alternate mechanical operation of said fluid-operated means for selectively displacing said locking means between said first and second positions.

2. The lock of claim 1 wherein said fluid-operated means is displaceable between first and second positions which are axially displaced with respect to each other along said axis and which correspond to said first and second positions of said locking means.

3. The lock of claim 2 wherein said fluid-operated means comprises a cylinder having a cylinder wall and a reciprocal plunger positioned therein, which is displaceable between the first and second positions.

4. The lock of claim 3 further comprising remote control means for remotely controlling the position of said reciprocable plunger.

5. The lock of claim 4 wherein said fluid-operated means is pneumatically controlled and said remote control means includes an air compressor.

6. The lock of claim 3 wherein said plunger includes means for engaging a mechanical override device to permit mechanical reciprocation of said plunger.

7. The lock of claim 6 wherein at least one of said handles is aligned with said engaging means along said axis, said one of said handles including means for selectively receiving a mechanical override device from the exterior of said at least one of said handles, the mechanical override device extending therethrough to engage said plunger.

8. The lock of claim 7 wherein said fluid-operated means uses fluid pressure to unlock the lock and wherein the mechanical override device is operable to mechanically reciprocate said plunger to unlock the lock in the absence of fluid pressure.

9. The lock of claim 3 further comprising fluid sensing means for sensing the position of said plunger, said sensing means including a conduit extending within said cylinder wall and which opens at one end into the interior of said cylinder at a position whch is covered by said plunger when said plunger is in one of said first or second positions, and which is uncovered when said plunger is in the other of said positions, and fluid pressure sensing means for sensing the fluid pressure within said conduit.

10. A fluid-controlled door lock comprising a lock chassis, a lock bolt movable relative to said chassis, a door handle rotatable relative to said chassis along an axis, means including a clutch for interconnecting said lock bolt and said door handle, and fluid control means operable in a direction substantially parallel to said axis and being connected to said chassis for operating said clutch;

said fluid control means including a cylinder having a fluid displaceable plunger therein which is adapted to selectively reciprocate in a direction parallel to said axis to operate said clutch;

said plunger reciprocating in response to a fluid pressure signal from remote control means;

a mechanical override device; and said fluid control means using fluid pressure to unlock the lock wherein said plunger includes means for engaging the mechanical override device to permit mechanical reciprocation of said plunger, thereby adapting the lock to be unlocked in the absence of fluid pressure.

* * * * *